United States Patent [19]

Nakagawa et al.

[11] 4,016,090

[45] Apr. 5, 1977

[54] STABLE BLEACHING COMPOSITION

[75] Inventors: Yunosuke Nakagawa, Koshigaya; Koitsu Sato, Funabashi, both of Japan

[73] Assignee: Kao Soap Co., Ltd., Tokyo, Japan

[22] Filed: Feb. 28, 1975

[21] Appl. No.: 554,012

[30] Foreign Application Priority Data

Mar. 6, 1974 Japan ..... 49-25995

[52] U.S. Cl. ..... 252/102; 8/111; 252/95; 252/99; 252/135; 252/186; 252/100; 252/103; 423/266

[51] Int. Cl.[2] ..... C11D 7/54

[58] Field of Search ..... 252/99, 95, 135, 186, 252/100, 103, 102; 423/266; 8/111

[56] References Cited

UNITED STATES PATENTS

| | | | |
|---|---|---|---|
| 3,553,140 | 1/1971 | Lindner et al. | 252/94 |
| 3,840,466 | 10/1974 | Gray | 252/99 |
| 3,951,840 | 4/1976 | Fujino et al. | 252/99 |

*Primary Examiner*—Mayer Weinblatt
*Attorney, Agent, or Firm*—Woodhams, Blanchard and Flynn

[57] ABSTRACT

A stable bleaching composition containing, as essential ingredients, an inorganic peroxide, an activating agent for said inorganic peroxide and potassium carbonate.

2 Claims, No Drawings

STABLE BLEACHING COMPOSITION

BACKGROUND OF THE INVENTION

1. FIELD OF THE INVENTION

This invention relates to a bleaching composition which possesses improved storage stability.

2. DESCRIPTION OF THE PRIOR ART

Inorganic peroxides that release hydrogen peroxide in aqueous solutions, such as sodium perborate and sodium percarbonate, are widely utilized as bleaching agents for commercial use and household use.

These inorganic peroxides exhibit a sufficient bleaching effect when the bleaching treatment is conducted at a high temperature such as 80° C. or higher, but at lower temperatures their bleaching effects are insufficient. There are known various activating agents for improving their bleaching effect at lower temperatures. These known activating agents are roughly divided into three groups, namely N-acyl compounds, esters and organic acid anhydrides. Such activating agents react with the inorganic peroxides in an aqueous solution to form an organic peracid. It is considered that the bleaching effect is enhanced by the thus-obtained increase of the oxidation potential. If such an inorganic peroxide and an activating agent therefore are mixed to form a bleaching composition, the composition can be conveniently used soon after it is prepared. However, if they are simply mixed and then the bleaching composition is stored, the storage stability of this composition is drastically reduced as compared with the storage stability of the inorganic peroxide alone. Thus bleaching compositions composed of a blend of an inorganic peroxide and an activating agent therefore do not possess adequate storage stability, i.e. the effective oxygen concentration in bleaching solutions made therefrom is greatly reduced if the compositions are stored for an appreciable period prior to use.

Some attempts have previously been made on special combinations of inorganic peroxides and activating agents to overcome the foregoing defects and to improve the storage stability of the bleaching composition. For instance, U.S. Pat. No. 3,639,248 teaches absorbing an inorganic acid anhydride, employed as an activating agent, on a granular inert substance, and British Pat. No. 906,358 teaches coating an N-acyl compound, employed as an activating agent, with a water-soluble film-forming substance such as polyvinyl alcohol and carboxymethyl cellulose. Further, British Pat. No. 864,798 proposes increasing the grain size of an ester used as the activating agent. We tried these known method and found that each of these proposals is not fully effective. Especially, the effect attained by the method of U.S. Pat. No. 3,639,248, which teaches that an acid anhydride is a typical example of the activating agent, is very inferior in storage stability. When the grain size of the activating agent is increased, as taught in British Pat. No. 864,798, if an ester of very low water-solubility such as glucose pentacetate is used, the bleaching effect is reduced at low temperature.

It is, therefore, a primary obect of this invention to provide an improved bleaching composition in which the activities of the inorganic peroxide and the activating agent are maintained at a high level and to provide a bleaching composition having an improved stability.

SUMMARY OF THE INVENTION

We have discovered that when potassium carbonate is incorporated into a mixture of an inorganic peroxide and an activating agent therefore, the storage stability of the resulting composition is greatly improved.

More specifically, in accordance with this invention, there is provided a bleaching composition comprising as indispensable ingredients (1) an inorganic peroxide, (2) an activating agent for said inorganic peroxide and (3) potassium carbonate. We have discovered, surprisingly in view of the prior art, that when potassium carbonate is employed, there is attained a very high storage stability, whereas a high storage stability cannot be attained by the use of other inorganic salts. This is an unexpected special effect attained by this invention.

As the inorganic peroxide used in this invention, there can be mentioned sodium percarbonate, sodium perborate, sodium peroxytripolyphosphate, sodium peroxypyrophosphate, sodium peroxysilicate and the like. As the activating agent for the inorganic peroxide, there are preferably employed acetic acid esters of polyhydric alcohols such as glucose pentacetate, sorbitol hexacetate, sucrose octacetate and the like, and N-acetyl compounds such as tetracetylethylenediamine, tetraacetylglycoluril and the like. Further, organic acid anhydrides such as phthalic anhydride and succinic anhydride can be used as the activating agent. It is preferred that anhydrous potassium carbonate is used as the potassium carbonate ingredient. Potassium carbonate containing water of crystallization does not provide a satisfactory effect.

The bleaching composition of this invention can be prepared by mixing the above three components at an optional weight ratio, but in view of the storage stability and the bleaching effect, and from the viewpoint of economical manufacture, it is preferred that the inorganic peroxide is used in an amount of 5 to 90 percent by weight, the activating agent is used in an amount of 1 to 40 percent by weight and potassium carbonate is used in an amount of 5 to 40 percent by weight, all percentages being expressed in terms of the total weight of the bleaching composition.

The bleaching composition of this invention can further contain, if desired, various optional ingredients such as water-soluble surfactants, water-soluble inorganic builder salts, anti-redeposition agents, perfumes, pigments, fluorescent dyes and the like, in addition to the foregoing three critical ingredients. As suitable surfactants, there can be mentioned anionic active agents such as sodium alkylbenzene sulfonates, sodium $\alpha$-olefinsulfonates, sodium alkanesulfonates, higher fatty acid sodium salts and sodium isethionate salts of higher fatty acids, and non-ionic surfactants such as polyoxyethylene alkyl ethers and polyoxyethylene alkylphenyl ethers. These surfactants are well known conventional surfactants used in clothes-washing detergent compositions and the like. As the inorganic builder salts, there can be used those builder salts customarily employed in detergent compositions, such as sodium sulfate, sodium carbonate, sodium bicarbonate, sodium silicate and polyphosphates such as sodium tripolyphosphate. As the anti-redeposition agent, there can be used polyethylene glycol having an average molecular weight of 1,000 to 20,000, carboxymethyl cellulose, polyvinyl alcohol, polyvinylpyrrolidone and the like.

In the bleaching composition of this invention, the three critical ingredients, namely the inorganic peroxide, the activating agent and potassium carbonate, can be mixed together in a finely divided powdery state, but in order to prevent scattering of fine particles and to improve the flowability of the composition, it is preferred that the three ingredients are granulated by appropriate granulating means.

This invention will now be described in more detail by reference to the following illustrative Examples. In the Examples all of the percentages are by weight.

EXAMPLE 1

Compositions of the following recipe are prepared:

| | |
|---|---|
| Sodium percarbonate | 70% |
| Glucose pentacetate | 20% |
| Inorganic salt (as listed in Table 1) | 10% |

The foregoing three ingredients, each having a grain size of 42 to 80 mesh, were mixed to form bleaching compositions. The thus-formed bleaching compositions were sealed in polyethylene bottles and were stored at 40° C. for 30 days. The effective oxygen concentration in the respective bleaching compositions were measured to determine the storage stability of the bleaching compositions. The results are shown in Table 1.

Table 1

| Inorganic Salt | Effective Oxygen Concentration A First Day (%) | B After 30 Days (%) | Ratio B/A (%) |
|---|---|---|---|
| sodium tripolyphosphate | 9.35 | 7.03 | 75.2 |
| sodium sulfate | 9.35 | 7.10 | 76.0 |
| sodium bicarbonate | 9.35 | 6.95 | 74.4 |
| sodium metasilicate | 9.35 | 5.87 | 62.7 |
| sodium nitrate | 9.35 | 6.80 | 72.8 |
| sodium chloride | 9.35 | 7.00 | 74.9 |
| sodium phosphate | 9.35 | 7.12 | 76.2 |
| sodium pyrophosphate | 9.35 | 7.00 | 74.9 |
| sodium metaborate | 9.35 | 6.23 | 66.6 |
| sodium borate | 9.35 | 5.45 | 58.7 |
| sodium bromide | 9.35 | 6.23 | 66.7 |
| potassium carbonate | 9.35 | 9.23 | 98.6 |

EXAMPLE 2

Compositions of the following recipe were prepared:

| | |
|---|---|
| Sodium percarbonate | 60% |
| Tetracetylglycoluril | 20% |
| Inorganic Salt (as listed in Table 2) | 20% |

In the same manner as described in Example 1, bleaching compositions containing the above ingredients were prepared, sealed in polyethylene bottles and stored at 40° C. for one month. In the same manner as described in Example 1, the effective oxygen concentration was measured. The results shown in Table 2 were obtained.

Table 2

| Inorganic Salt | Effective Oxygen Concentration A First Day (%) | B After One Month (%) | Ratio B/A (%) |
|---|---|---|---|
| potassium chloride | 8.10 | 6.50 | 80.2 |
| potassium phosphate | 8.10 | 5.00 | 61.6 |
| potassium sulfate | 8.10 | 6.80 | 84.0 |
| potassium carbonate | 8.10 | 8.05 | 99.5 |

EXAMPLE 3

Compositions of the following recipe were prepared:

| | |
|---|---|
| Sodium percarbonate | 60% |
| Detergent active component* | 10% |
| Tetracetylglycoluril | 20% |
| Inorganic salt (as listed in Table 3) | 10% |

*The detergent active component had the following composition:

| | |
|---|---|
| sodium dodecylbenzenesulfonate | 60% |
| sodium sulfate | 35% |
| water | 5% |

A bleaching compositions having the above ingredients were prepared and stored at 40° C. for one month in the same manner as in Example 1. The effective oxygen concentration in the bleaching compositions was measured. The results shown in Table 3 were obtained.

Table 3

| Inorganic Salt | Effective Oxygen Concentration A First Day (%) | B After One Month (%) | Ratio B/A(%) |
|---|---|---|---|
| potassium carbonate | 8.10 | 8.00 | 98.6 |
| sodium carbonate | 8.10 | 4.50 | 55.5 |
| lithium carbonate | 8.10 | 1.85 | 22.8 |
| magnesium carbonate | 8.10 | 2.10 | 25.9 |
| calcium carbonate | 8.10 | 1.05 | 12.9 |

As is apparent from the results shown in Tables 1, 2 and 3, when various inorganic metal salts are incorporated into combinations of sodium percarbonate and an activating agent although the salts other than potassium carbonate do not have any significant effect of improving the storage stability of sodium percarbonate, the incorporation of anhydrous potassium carbonate results in major improvement of the storage stability.

EXAMPLE 4

Bleaching agents having the compositions as listed in Table 4 were prepared, and the storage stability thereof was examined under the same conditions as employed in Example 3. The results shown in Table 4 were obtained.

Table 4

| | Composition I | Composition II |
|---|---|---|
| Sodium perborate | 10% | 10% |

Table 4-continued

| | Composition I | Composition II |
|---|---|---|
| Sorbitol hexacetate | 20% | 20% |
| Potassium carbonate | 20% | — |
| Sodium sulfate | 30% | 50% |
| Sodium tripoly-phosphate | 20% | 20% |
| Effective oxygen concentration ratio B/A (%) | 95.2% | 63.0% |

From the results shown in Table 4, it is apparent that also when sorbitol hexacetate is used as the activating agent for sodium perborate, the storage stability is greatly improved by the addition of potassium carbonate.

EXAMPLE 5

| | |
|---|---|
| Sodium peroxytripolyphosphate | 20% |
| Glucose pentacetate | 10% |
| Sodium sulfate | 50% |
| Potassium carbonate | 20% |

A bleaching agent having the above composition was prepared. For comparison, a control composition was prepared in which the potassium carbonate was omitted and the other ingredients were the same. The bleaching agent, according to the invention, had an excellent storage stability in comparison with the control composition free of potassium carbonate when stored at room temperature in a sealed bottle for 30 days.

EXAMPLE 6

| | |
|---|---|
| Sodium peroxypyrophosphate | 20% |
| Succinic anhydride | 10% |
| Sodium sulfate | 50% |
| Potassium carbonate | 20% |

A bleaching agent having the above composition exhibited an excellent storage stability in comparison with a control bleaching agent which did not contain potassium carbonate.

The embodiments of the invention in which an exclusive property or privilege is claimed are defined as follows:

1. A dry, powder form, bleaching composition having an improved storage stability, consisting essentially of: from 5 to 90 percent by weight of sodium percarbonate; from one to 40 percent by weight of an activator for said sodium percarbonate and capable of increasing the bleaching effect of said sodium percarbonate in aqueous solution at a temperature below 80° C; and from 5 to 40 percent by weight of anhydrous potassium carbonate.

2. A bleaching composition according to claim 1 in which said activator is selected from the group consisting of acetic acid esters of polyhydric alcohols, tetraacetylethylenediamine, tetraacetylglycoluril, phthalic anhydride and succinic anhydride.

* * * * *